US007571700B2

(12) United States Patent
Ogawa et al.

(10) Patent No.: US 7,571,700 B2
(45) Date of Patent: Aug. 11, 2009

(54) VALVE TIMING CONTROL APPARATUS

(75) Inventors: Kazumi Ogawa, Toyota (JP); Atsushi Sato, Toyota (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 167 days.

(21) Appl. No.: 11/629,978

(22) PCT Filed: Jun. 21, 2005

(86) PCT No.: PCT/JP2005/011317

§ 371 (c)(1),
(2), (4) Date: Dec. 19, 2006

(87) PCT Pub. No.: WO2005/124110

PCT Pub. Date: Dec. 29, 2005

(65) Prior Publication Data

US 2008/0017143 A1 Jan. 24, 2008

(30) Foreign Application Priority Data

Jun. 22, 2004 (JP) ..... 2004-183845

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 4,074,956 A * 2/1978 Maruyama et al. ..... 418/178
5,832,887 A 11/1998 Adachi et al.
6,314,929 B1 * 11/2001 Maeyama et al. ..... 123/90.17
6,669,567 B1 12/2003 Scheidt et al.
7,025,135 B2 * 4/2006 Ellington et al. ..... 166/207
2005/0066922 A1 3/2005 Knecht et al.

FOREIGN PATENT DOCUMENTS

DE 42 21 892 A1 1/1994

(Continued)

OTHER PUBLICATIONS

International Search Report.

(Continued)

*Primary Examiner*—Ching Chang
(74) *Attorney, Agent, or Firm*—Buchanan Ingersoll & Rooney PC

(57) ABSTRACT

A valve timing control apparatus includes a rotor linked to a camshaft of an internal combustion engine. A drive member is linked to the drive shaft of the internal combustion engine and supports the rotor in a relatively rotational manner. A hydraulic chamber is partitioned by a vane and is disposed between the rotor and the drive member 30. The drive member includes an outer rotor forming the hydraulic chamber together with the rotor 2, a housing member including a front plate portion joined to one axial end of the outer rotor and a tubular portion linked the front plate portion and positioned on the outer radial side of the outer rotor, and a rear plate member joined to the other axial end of the outer rotor and to the housing member.

8 Claims, 1 Drawing Sheet

FOREIGN PATENT DOCUMENTS

| | | | |
|---|---|---|---|
| DE | 199 51 390 | A1 | 5/2001 |
| DE | 101 09 837 | A1 | 9/2002 |
| JP | 10-110604 | A | 4/1998 |
| JP | 11-81925 | A | 3/1999 |
| JP | 11-311108 | A | 11/1999 |
| JP | 2002-013403 | A | 1/2002 |
| JP | 2002-188414 | A | 7/2002 |
| JP | 2002-256824 | A | 9/2002 |
| WO | WO 03/076771 | A1 | 9/2003 |

OTHER PUBLICATIONS

Supplementary European Search Report issued in European Application No. 05753485.1.

* cited by examiner

VALVE TIMING CONTROL APPARATUS

TECHNICAL FIELD

The present invention relates to a valve timing control apparatus which controls the timing of the opening and closing of intake and exhaust valves in an internal combustion engine.

BACKGROUND ART

Conventional valve timing control apparatuses include those having a rotor linked to a camshaft of an internal combustion engine; a housing member for supporting the rotor in a relatively rotational manner; a front plate member joined to one axial end of the housing member; a rear plate member joined to the other axial end of the housing member and provided with a drive portion linked to the drive shaft of the internal combustion engine; a hydraulic chamber partitioned by a vane and provided between the rotor and a housing that comprises the housing member, the front plate member, and the rear plate member; and a front cover that covers the front plate member and the housing member forming the hydraulic chamber, and is joined to the rear plate member via a seal member (for an example, see Patent Document 1).

[Patent Document 1] Japanese Laid-open Patent Application No. 2002-188414

DISCLOSURE OF THE INVENTION

Problems that the Invention is Intended to Solve

In conventional valve timing control apparatuses such as that described above, the housing member and the front plate member are covered with a front cover in order to prevent oil supplied to the hydraulic chamber from leaking out of the internal combustion engine. Adopting this approach has been problematic in that the apparatus is made larger in the axial direction, and the number of parts increases, driving up costs. Another problem is that a larger apparatus limits the degree of freedom in mounting the apparatus in the internal combustion engine.

In view of the foregoing, a technical object of the present invention is to prevent oil from leaking out, to reduce axial dimensions, and to reduce the number of parts and the cost in a valve timing control apparatus.

Means for Solving the Problems

The technical means employed by the present invention for solving the above-mentioned problems relate to a valve timing control apparatus comprising a driven member linked to a camshaft of an internal combustion engine; a drive member which is linked to the drive shaft of the internal combustion engine and supports the driven member in a relatively rotational manner; and a hydraulic chamber which is partitioned by a vane and is disposed between the driven member and the drive member, wherein the drive member comprises an outer rotor forming the hydraulic chamber together with the driven member; a housing member including a front plate portion joined to one axial end of the outer rotor and a tubular portion linked the front plate portion and positioned on the outer radial side of the outer rotor; and a rear plate member joined to the other axial end of the outer rotor and to the housing member.

According to these technical means, the periphery of the hydraulic chamber can be enclosed by the tubular portion and the front plate portion of the housing member. Therefore, oil in the hydraulic chamber can be prevented from leaking through the housing member to the outside. Furthermore, the housing member can double as a covering member for covering the periphery of the drive member, allowing the drive member to be made more compact in the axial direction, and the number of parts and the cost to be reduced. The outer rotor and the housing member can be separate members, whereby the outer rotor and the housing member can be formed from different materials.

According to a further technical means used to solve the above-mentioned problems, the housing member, the outer rotor, and the rear plate member are integrally fixed together by a fastening member, a head portion of the fastening member is interlocked with the rear plate member, a shaft portion thereof is passed through a hole in the outer rotor, and the sealant-coated male threaded portion is threadably engaged with a female threaded portion of the housing member.

According to these technical means, the sealant-coated male threaded portion of the fastening member is threadably engaged with the female threaded portion of the housing member, preventing the oil in the hydraulic chamber from leaking to the outside from between the fastening member and the housing member. Therefore, oil leakage can be prevented using a simple configuration.

According to a further technical means used to solve the above-mentioned problems, the hole has a stepped tubular shape, with a large-diameter portion on the side of the front plate portion and a small-diameter portion on the side of the rear plate member.

According to these technical means, excess sealant squeezed out by the threadable engagement of the fastening member and the housing member flows into the large-diameter portion of the hole to form a seal, and can therefore be prevented from flowing toward the hydraulic chamber.

According to a further technical means used to solve the above-mentioned problems, a through hole for passing the fastening member is formed in the rear plate member, and a seal member is provided for sealing the through hole.

According to these technical means, the oil in the hydraulic chamber can be prevented from leaking out from between the fastening member and the rear plate member. Therefore, oil leakage can be prevented using a simple configuration.

According to a further technical means used to solve the above-mentioned problems, the through hole has a larger diameter than the small-diameter portion of the hole; at least a portion of the head portion of the fastening member is inserted into the through hole; and the seal member is placed within the through hole and is sandwiched between the head portion of the fastening member and the other axial end of the outer rotor.

According to these technical means, the seal between the fastening member and the rear plate member can be adequately ensured using a simple structure in which the seal member is merely sandwiched between the head portion of the fastening member and the other axial end of the outer rotor.

A further technical means used to solve the above-mentioned problems has a seal member disposed on the joint surface of the housing member and the rear plate member.

According to these technical means, the oil in the hydraulic chamber can be prevented from leaking out from between the housing member and the rear plate member.

According to a further technical means used to solve the above-mentioned problems, the outer rotor is composed of an iron-based metal, and the housing member is composed of a light metal.

According to these technical means, the housing member and the entire apparatus can be made more lightweight while the strength of the outer rotor is ensured.

EFFECT OF THE INVENTION

According to the present invention, the oil in the hydraulic chamber can be prevented from leaking to the outside of the housing member. Furthermore, the drive member can be made more compact in the axial direction, and the number of parts and the cost can be reduced.

BEST MODE FOR CARRYING OUT THE INVENTION

An embodiment of a valve timing control apparatus 1 according to the present invention will be described below with reference to the accompanying drawings.

As shown in FIG. 1, the valve timing control apparatus primarily comprises a rotor (driven member) 2 that is integrally assembled with and linked to the distal end of a camshaft 1 of an internal combustion engine, and a drive member 30 that is linked to the drive shaft (not shown) of the internal combustion engine and that supports the rotor 2 in a relatively rotational manner within a specific range. A hydraulic chamber 35 partitioned by a vane 6 is provided between the rotor 2 and the drive member 30.

The camshaft 1 has a cam (not shown) for opening and closing the intake or exhaust valves (not shown) of the internal combustion engine. The camshaft 1 is rotatably supported by a cylinder head 5 of the internal combustion engine.

The rotor 2 is integrally fixed by a bolt 23 to the axially forward end (left side in FIG. 1) of the camshaft 1. The rotor 2 rotatably engages the internal peripheral surface 31*d* of protrusions 31*a* on an outer rotor 31, which will be described below. The rotor 2 includes the vanes 6 along its outer periphery, with each vane 6 extending radially outward (vertical direction in FIG. 1) and partitioning the hydraulic chamber 35 formed between the rotor 2 and the drive member 30 into a spark-advance chamber and a spark-retard chamber.

The drive member 30 has the outer rotor 31 forming the hydraulic chamber 35 together with the rotor 2, a substantially bottomed tubular housing member 3 for housing the outer rotor 31 in the internal peripheral part thereof, and a rear plate member 4 joined to the end face 3*a* on the side of the opening in the housing member 3. A seal member 38 is disposed on the joint surface of the housing member 3 and the rear plate member 4. The seal member 38 seals the joint surface of the housing member 3 and the rear plate member 4, and is provided to prevent leakage of oil from the hydraulic chamber 35 to the outside.

As shown in FIG. 2, the housing member 3, the outer rotor 31, and the rear plate member 4 are integrally fixed together by a bolt (fastening member) 36. The head portion 36*b* of the bolt 36 engages the rear plate member 4, the shaft portion 36*c* passes through a hole 31*c* in the outer rotor 31, and a male threaded portion 36*a* is threadably engaged with a female threaded portion 32*a* of the housing member 3. The male threaded portion 36*a* of the bolt 36 is threadably engaged with the female threaded portion 32*a* of the housing member 3 while coated with a sealant A. The sealant A is provided in order to seal the fastened portions of the bolt 36 and the housing member 3, and to prevent the oil in the hydraulic chamber 35 from lealing to the outside.

The outer rotor 31 and the housing member 3 are separate members integrally fixed together by the bolt 36, allowing for the outer rotor 31 and the housing member 3 to be formed from different materials. In this case, the outer rotor 31 is preferably composed of an iron-based metal, and the housing member 3 is preferably composed of aluminum or another light metal. The required strength can thereby be obtained for the outer rotor 2, and the housing member 3 and the entire apparatus can be made more lightweight.

The radially inwardly extending protrusions 31*a* are formed spaced around the periphery of the outer rotor 31. The hydraulic chamber 35 is formed in the space between adjoining protrusions 31*a*. The rotor 2 is rotationally engaged with the internal peripheral surface 31*d* of the protrusions 31*a*. The vanes 6, which partition the hydraulic chamber 35 into spark-advance and spark-retard chambers in a liquid-tight manner as mentioned above, are in frictional contact with the internal peripheral surface 31*b* of the outer rotor.

The housing member 3 is a substantially bottomed tubular member having a front plate portion 32 that is joined to one axial end (left side in FIG. 1) of the outer rotor 31, and a tubular portion 33 that is integrally linked the front plate portion 32 and is disposed on the outer radial side of the outer rotor 31. The front plate portion 32 and the tubular portion 33 of the housing member 3 are thereby linked as a single unit enclosing the periphery of the hydraulic chamber 35. Therefore, the sealing of the hydraulic chamber 35 by the housing member 3 can be improved and the oil in the hydraulic chamber 35 can be prevented from leaking to the outside of the housing member 3. Further, the housing member 3 can double as a covering member for covering the periphery of the drive member 30, allowing the drive member 30 to be made more compact in the axial direction, the apparatus to be made smaller, and the number of parts and the cost to be reduced.

The front plate portion 32 comprises a tubular portion 32*c* that has a hole 32*b* for fastening the bolt 23, and a discoid portion 32*d* for hermetically closing the front side of the hydraulic chamber 35. The hole 32*b* provided in the central part of the front plate portion 32 is blocked in a liquid-tight manner by fixing a cap 37 with the aid of a seal washer 37*a*. The front plate portion 32 is positioned in contact with the axial front-end surface (an end side) 31*g* of the outer rotor 31. The front plate portion 32 blocks the front end face (left side in FIG. 1) of the hydraulic chamber 35. In other words, the internal peripheral part of the discoid portion 32*d* of the front plate portion 32 is in frictional contact with the front-end surface 2*g* of the rotor 2 and blocks the front side of the hydraulic chamber 35. Furthermore, the discoid portion 32*d* is in frictional contact with the front-end surface 6*g* of the vanes 6 and partitions the hydraulic chamber 35 into spark-advance and spark-retard chambers in a liquid-tight manner.

A torsion spring 7 is positioned between a depression 32*e* formed on the internal periphery of the tubular portion 32*c* of the front plate portion 32, and a circular groove 31*k* formed on the front-end surface (an end side) 31*g* in the axial direction of the rotor 2. The torsion spring 7 is attached to the front plate portion 32 on one end and to the rotor 2 on the other end. The torsion spring 7 thereby urges the rotor 2 to advance straight forward in relation to the drive member 30.

The housing member 3 and the rear plate member 4 are integrally fixed together by the bolt 36. The bolt 36 passes through the hole 31*c* of the outer rotor 31, and the male threaded portion 36*a* coated with sealant A threadably engages the female threaded portion 32*a* formed on the front plate portion 32. The hole 31*c* is formed as a stepped cylinder in which the level changes in the axially directed intermediate portion of the hole, as shown in FIG. 2. In other words, the hole 31*c* has a small-diameter portion 31*m*, formed on the rear side (the side facing the rear plate member 4, the right side in FIG. 2) of the outer rotor 31, and a large-diameter portion 31*j*, having a larger diameter than the small-diameter portion 31*m*, on the front side (the side facing the front plate portion 32, the left side in FIG. 2) of the outer rotor 31. Therefore, excess sealant A squeezed out by the threadable engagement of the male threaded portion 36*a* of the bolt 36 coated with sealant A and the female threaded portion 32*a* of the front plate portion 32 flows into space S formed by the internal periphery of the large-diameter portion 31*j* and the external periphery of the bolt 36 to form a seal. Accordingly, sealant A can therefore be prevented from flowing toward the hydraulic chamber 35 and contaminating the oil therein. The large-diameter portion 31*j* may also be formed on the side of the female threaded portion 32*a* that faces the outer rotor 31.

A seal member 39 is disposed between the head portion 36*b* of the bolt 36 and the rear plate member 4, as shown in FIG. 2. The seal member 39 seals the hydraulic chamber 35 in a liquid-tight manner. A through hole 4*c* for passing the bolt 36 is formed in the rear plate member 4, as shown in FIG. 1. The seal member 39 is configured to seal the through hole 4*c*. In other words, the through hole 4*c* has a larger diameter than the small-diameter portion 31*m* of the hole 31*c*, and at least part of the head portion 36*b* of the bolt 36 is inserted into the through hole 4*c*. In this case, the entire head portion 36*b* of the bolt 36 is inserted so as to fit in the through hole 4*c*. The seal member 39 is placed within the through hole 4*c* and is sandwiched between the head portion 36*b* of the bolt 36 and the axial back-end surface (the surface on the other axial end, the surface on the right side in FIG. 1) 31*h* of the outer rotor 31. The seal member 39 thereby seals the space within the through hole 4*c*, which is enclosed by the head portion 36*b* of the bolt 36, the axial back-end surface 31*h* of the outer rotor 31, and the through hole 4*c* of the rear plate member 4. Therefore, the oil in the hydraulic chamber 35 can be prevented from leaking out from between the bolt 36 and the rear plate member 4.

The rear plate member 4 has a larger diameter than the housing member 3, is joined to the axial back-end surface 31*h* of the outer rotor 31, and blocks the rear side (the right side in FIG. 1) of the hydraulic chamber 35. The internal peripheral part of the rear plate member 4 is in frictional contact with the back-end surface 2*h* of the rotor 2, blocking the rear side of the hydraulic chamber 35. A round tubular portion 4*b* protruding toward the camshaft 1 is formed in the central part of the rear plate 4. An oil seal 5*a* is disposed between the external periphery of the round tubular portion 4*b* and the cylinder head 5, blocking the hydraulic chamber 35 in a liquid-tight manner. The rear plate member 4 is supported while allowed to rotate relative to the rotor 2 and the camshaft 1. Furthermore, a pulley 4*a* is formed integrally on the external periphery that protrudes radially outward beyond the external peripheral surface 3*b* of the housing [member] 3 of the rear plate member 4.

Following is a description of the operation of a valve timing control apparatus configured as described above.

While oil is fed through supply lines connected to the spark-advance and spark-retard chambers of the hydraulic chamber 35, a torque transmitted from the crankshaft of the internal combustion engine to the pulley 4*a* is further transmitted from the drive member 30 to the rotor 2 via the oil thus fed, whereby the pulley 4*a* and the camshaft 1 are made to rotate integrally together. As a result, the camshaft 1 of the internal combustion engine is caused to rotate in sync with the crankshaft of the internal combustion engine. In this case, the outer rotor 31, which forms the hydraulic chamber 35, is covered by the housing member 3, which has the front plate portion 32 and the tubular portion 33 linked thereto. Furthermore, the housing member 3 is joined and fixed to the rear plate member 4 via the seal member 38. Therefore, the oil fed to the hydraulic chamber 35 is prevented from leaking to the outside.

The rate at which the oil is fed in this state is adjusted, and the oil pressure generated in the spark-advance and spark-retard chambers of the hydraulic chamber 35 is also adjusted, whereupon the rotor 2 is caused to rotate relative to the drive member 30, and the position of the camshaft 1 relative to the pulley 4*a* is varied. The rotation timing of the camshaft 1 of the internal combustion engine relative to the drives shaft is thus adjusted.

DESCRIPTION OF REFERENCE MARKS

1 Camshaft

2 Rotor (driven member)

3 Housing member

4 Rear plate member

4*c* Through hole

6 Vane

30 Drive member

31 Outer rotor

31*c* Hole

31*j* Large-diameter portion

31*m* Small-diameter portion

32 Front plate portion

32*a* Female threaded portion

33 Tubular portion

35 Hydraulic chamber

36 Bolt (fastening member)

36*a* Male threaded portion

36*b* Head portion

36*c* Shaft portion

Figure 1:
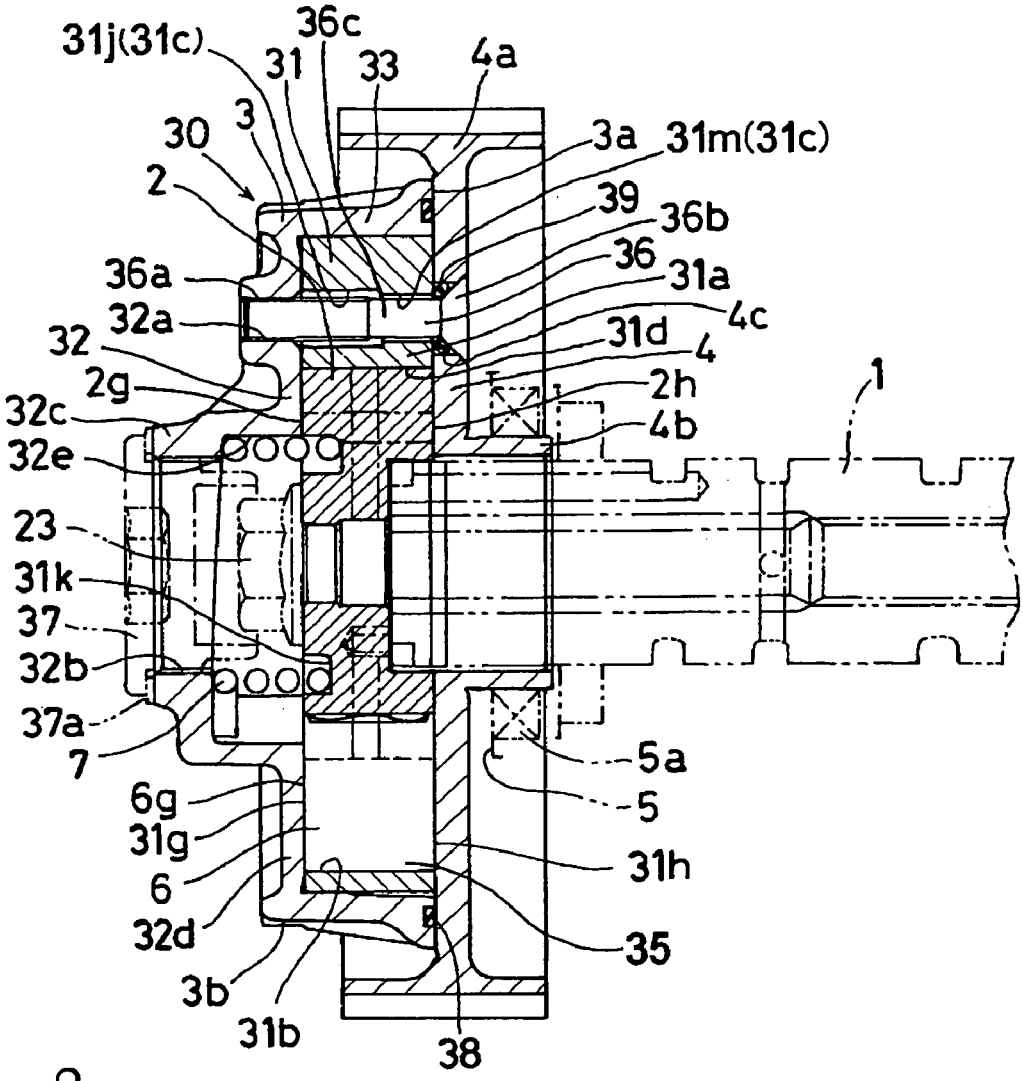
FIG. 1 is a longitudinal section of a valve timing control apparatus 1 showing an embodiment of the present invention.
Figure 2:
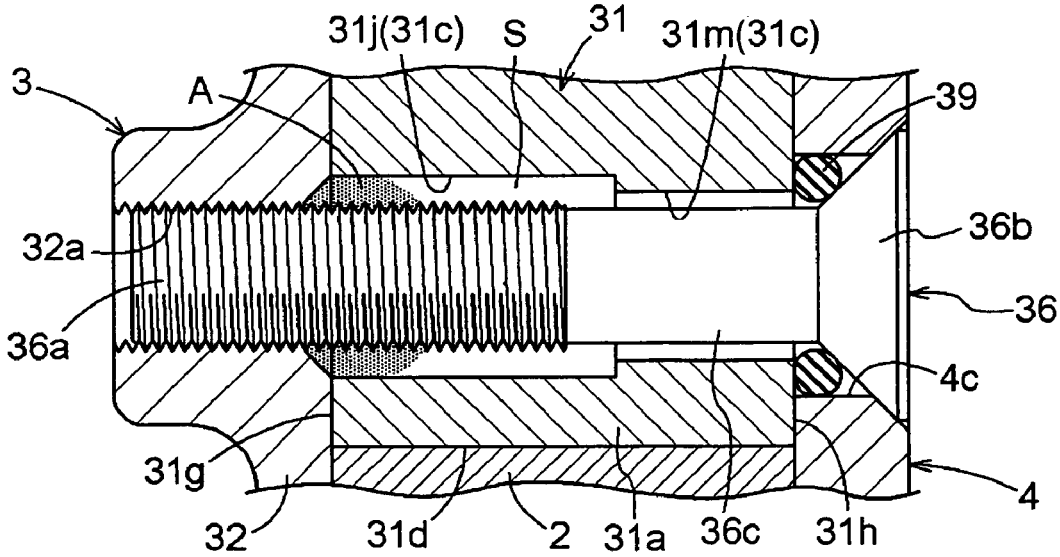
FIG. 2 is a magnified view of the bolt region in which the housing member, the outer rotor, and the rear plate member are fixed together.

38 Seal member on joint surface of housing member and rear plate member

39 Seal member for seal member

A Sealant

The invention claimed is:

1. A valve timing control apparatus comprising:

a driven member linked to a camshaft of an internal combustion engine;

a drive member which is linked to a drive shaft of the internal combustion engine and supports the driven member in a relatively rotational manner; and a hydraulic chamber which is partitioned by a vane and is disposed between the driven member and the drive member, wherein the drive member comprises:

an outer rotor forming the hydraulic chamber together with the driven member;

a housing member including a front plate portion joined to one axial end of the outer rotor and a tubular portion linked with the front plate portion and positioned on the outer radial side of the outer rotor; and a rear plate member joined to the other axial end of the outer rotor and to the housing member;

and wherein the housing member, the outer rotor, and the rear plate member are integrally fixed together by a fastening member;

a head portion of the fastening member is interlocked with the rear plate member, a shaft portion thereof is passed through a hole in the outer rotor, and a sealant-coated male threaded portion is threadably engaged with a female threaded portion of the housing member; and the hole has a stepped tubular shape with a large-diameter portion on the side facing the front plate portion and a small-diameter portion on the side facing the rear plate member.

2. The valve timing control apparatus according to claim 1, wherein a through hole for passing the fastening member is formed in the rear plate member, and a seal member is provided for sealing the through hole.

3. The valve timing control apparatus according to claim 2, wherein the through hole has a larger diameter than the small-diameter portion of the hole;

at least a portion of the head portion of the fastening member is inserted into the through hole; and the seal member is placed within the through hole and sandwiched between the head portion of the fastening member and the other axial end of the outer rotor.

4. The valve timing control apparatus according to claim 1, further comprising a seal member disposed on the joint surface of the housing member and the rear plate member.

5. The valve timing control apparatus according to claim 1, wherein the outer rotor is composed of an iron-based metal, and the housing member is composed of a light metal.

6. The valve timing control apparatus according to claim 1, wherein the outer rotor possesses an outer surface and the tubular portion entirely covers the outer surface of the outer rotor.

7. The valve timing control apparatus according to claim 1, wherein the tubular portion contacts the rear plate member and is fixed thereto.

8. The valve timing control apparatus according to claim 7, further comprising a seal member disposed between the tubular portion and the rear plate member.

* * * * *